US006257668B1

(12) United States Patent
Chou et al.

(10) Patent No.: US 6,257,668 B1
(45) Date of Patent: Jul. 10, 2001

(54) CHAIR ARMREST JOINT ADJUSTABLE FOR 360° IN ANY DIRECTION ABOUT A SHAFT

(76) Inventors: Ding-Guo Chou, No. 2 Alley 11, Lane 344, Chung Cheng South Rd., Yungkang, Tainan County; Guo-Qing Chou, No. 14 Lane 41, Feng Sung Rd., Fengshan, Kaohsiung County, both of (TW)

( * ) Notice: Subject to any disclaimer, the term of this patent is extended or adjusted under 35 U.S.C. 154(b) by 0 days.

(21) Appl. No.: 09/370,551

(22) Filed: Aug. 9, 1999

(51) Int. Cl.[7] ..... A47C 7/54
(52) U.S. Cl. ..... 297/411.32; 297/411.38
(58) Field of Search ..... 297/373, 411.32, 297/411.35, 411.38; 453/97

(56) References Cited

U.S. PATENT DOCUMENTS 2,137,335 * 11/1938 Gabb ..... 297/373 X
3,397,912 * 8/1968 Bush ..... 297/411.35 X
4,614,452 * 9/1986 Wang ..... 403/97 X
4,807,935 * 2/1989 King ..... 297/411.38
5,056,391 * 10/1991 Stewart ..... 403/97 X
5,275,465 * 1/1994 Gulliver et al. ..... 297/411.32 X
5,678,896 * 10/1997 Chung ..... 297/411.38

FOREIGN PATENT DOCUMENTS

1054858 * 4/1959 (DE) ..... 297/373
993321 * 10/1951 (FR) ..... 297/373

* cited by examiner

*Primary Examiner*—Peter R. Brown
(74) *Attorney, Agent, or Firm*—Alan Kamrath; Rider, Bennett, Egan & Arundel, LLP

(57) ABSTRACT

A chair armrest joint adjustable for 360° in any direction about a shaft includes a fix member, a movable member and a rotatable member, fixed between an armrest and the seat of a chair. The movable member is fixed on a connector fixed on the armrest, and the fix member is fixed on a seat bracket. When the rotatable member is rotated in one direction, the movable member may be rotated to let the armrest slope in any direction, disengaged from the fix member. Then the rotatable member is rotated reversely to force the movable member to engage with the fix member to lock the movable member and the armrest in the adjusted position. The fix member and the movable member both have teeth on their contacting surface to engage with each other or disengage from each other.

15 Claims, 7 Drawing Sheets

CHAIR ARMREST JOINT ADJUSTABLE FOR 360° IN ANY DIRECTION ABOUT A SHAFT

BACKGROUND OF THE INVENTION

This invention relates to a chair armrest joint adjustable for 360° in any direction, about a shaft particularly to make it possible to let one or two armrests of a chair to be moved to slope in minute various directions or bend down so as to let the arms of a person freely move.

Traditional chairs have a wide variety, some with rollers to move around on the ground, some with the seat adjustable in its height, some with the backrest possible to be reclined, some with the armrest adjustable in its height, etc. There are many kinds of armrest adjusting devices in conventional chairs, mostly adjustable in its height, or in horizontal movement to the right and left or forward and backward, but no adjusting device for sloping in any direction about a shaft.

SUMMARY OF THE INVENTION

This invention has been devised to offer a chair armrest joint adjustable for 360° in any direction about a shaft.

The feature of the invention is a fix member fixed on a seat bracket, a movable member fixed under an armrest of a chair, and a rotatable member to force the movable member to engage with or disengage from the fix member. The armrest, can be moved to slope in various minute directions and then locked again at the adjusted position by disengaging and then engaging the movable member with the fix member. Engagement or disengagement of the fix member and the movable member is effected by rotation of the rotatable member by means of teeth formed on contacting surfaces of both the fix member and the movable member.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
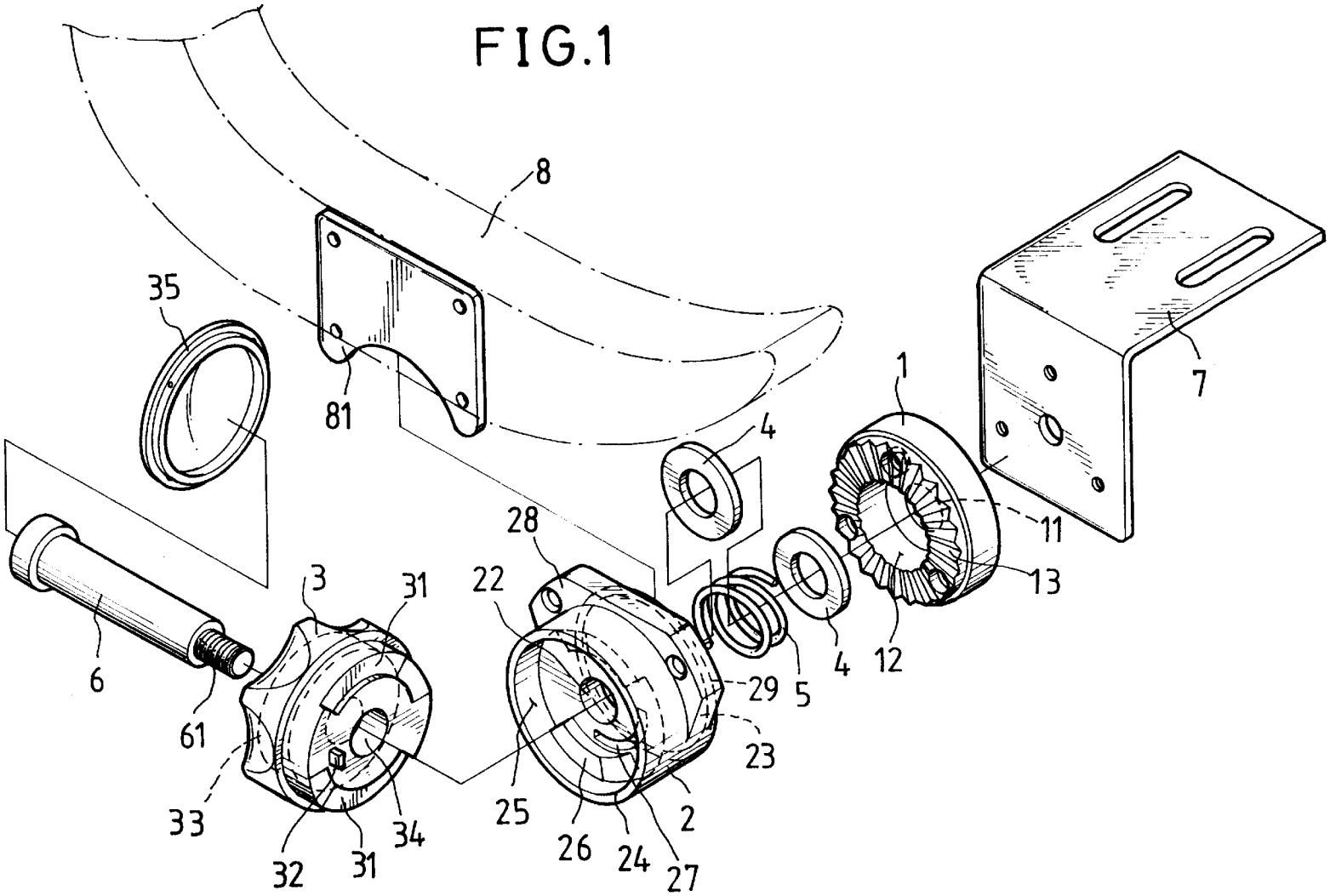
FIG. 1 is an exploded perspective view of a chair armrest joint adjustable for 360° in any direction about a shaft in the present invention.
Figure 2:
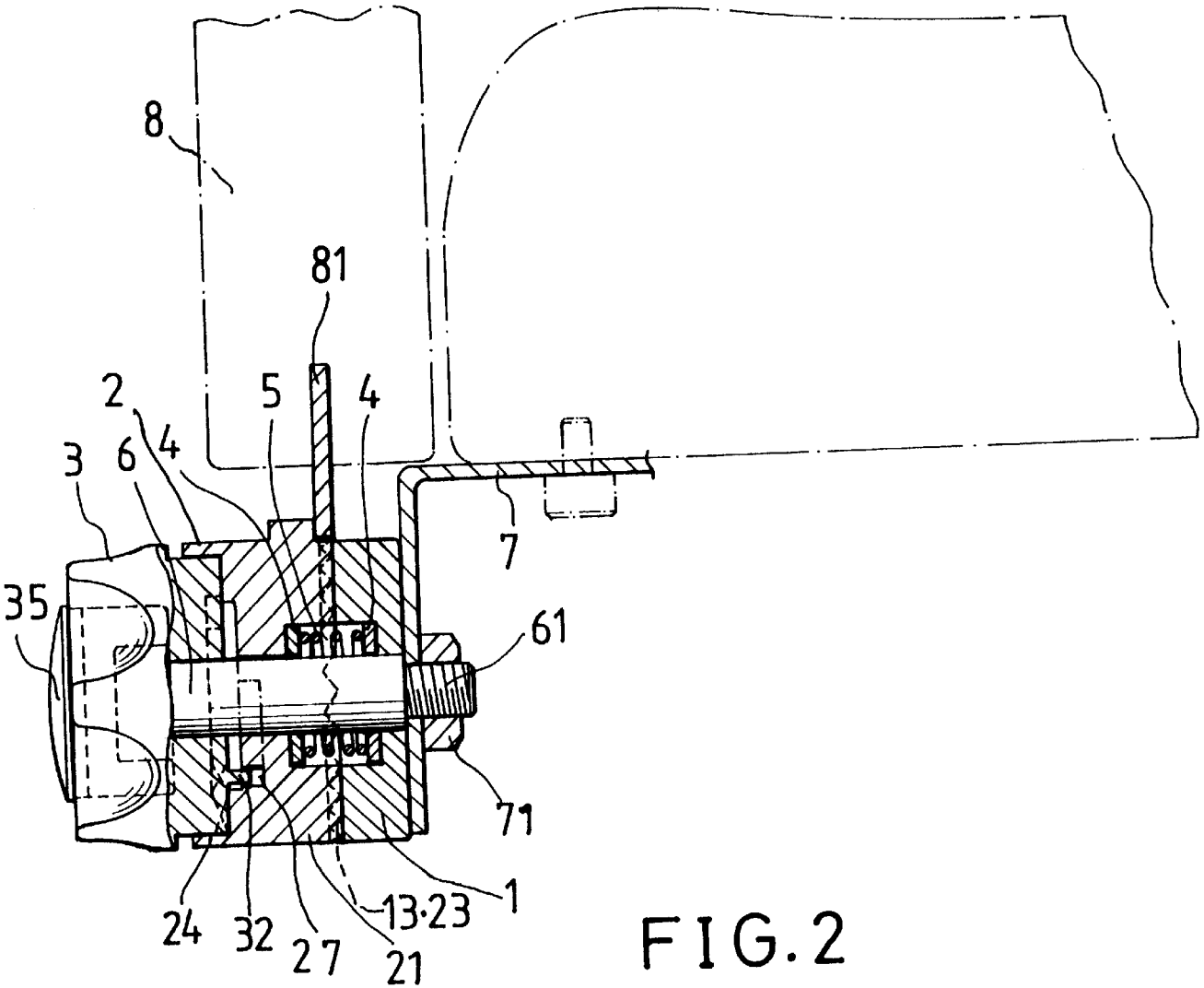
FIG. 2 is a front cross-sectional view of the chair armrest joint in the present invention.

A preferred embodiment of a chair armrest joint adjustable for 360° in any direction about a shaft in the present invention, as shown in FIGS. 1 and 2, includes a fix member 1, a movable member 2, and a rotatable member 3 combined together.

The fix member 1 is shaped round, having a right flat side to contact a vertical portion of a seat bracket 7 and secured to the seat bracket 7 with screws. The fix member 1 further has a center hole 11, a first center cavity 12 formed in a left side to communicate with the center hole 11, and a plurality of continuous radial teeth 13 formed on the left side surface.

The movable member 2 is to be fixed with a connector 81 of an armrest 8, having a second cavity 21 formed in a right side, a center hole 22 formed in an intermediate vertical wall, a plurality of continuous radial teeth 23 formed on the right side of the intermediate wall, and an annular wall 24 in a left side defining a third cavity 25. A curved sloped guide section 26 is formed on an inner surface of the annular wall 24, and a limit curved slot 27 is formed in the intermediate wall 24 beside the sloped guide section 26.

An annular gasket 4 and a spring 5 are fitted tightly in the first cavity 12 and the second cavity 21 of the fix member 1 and the movable member 2 after both are combined together.

The movable member 2 further has a connect portion 28 vertically on the right side to be secured with screws 82 with the lower portion of the connector 81 under the seat. The movable member 2 further has an annular wall 29 extending out of the right side for a left side portion of the fix member 1 to fit therein and be protected by the annular wall 29, whether the fix member 1 engages with the movable member 2 or not, always hiding the left side of the fix member 1.

The rotatable member 3 is partly fitted in the movable member 2 for controlling the engaging or disengaging gap between the fix member 1 and the movable member 2. The rotatable member 3 has a sloped guide surface 31 on the right side, a projection 32 beside the guide surface 31, a fourth center cavity 33 formed in the left side, and a center hole 34. A shaft 6 passes through center hole 34 of the rotatable member 3 and further passes through the center holes 22 and 11 of the movable member 2 and the fix member 1, and also through the gasket 4 and the spring 5. Then the threaded portion 61 of the shaft 6 protrudes through a hole in the seat bracket 7 to screw with a nut 71 tightly, securing the fix member 1, the movable member 2 and the rotatable member 3 together.

A cap 35 is provided to fit tightly in an inner wall of the fourth center cavity 33, after the shaft 6, the rotatable member 3, the movable member 2 and the fix member 1 are assembled together.

Figure 3:
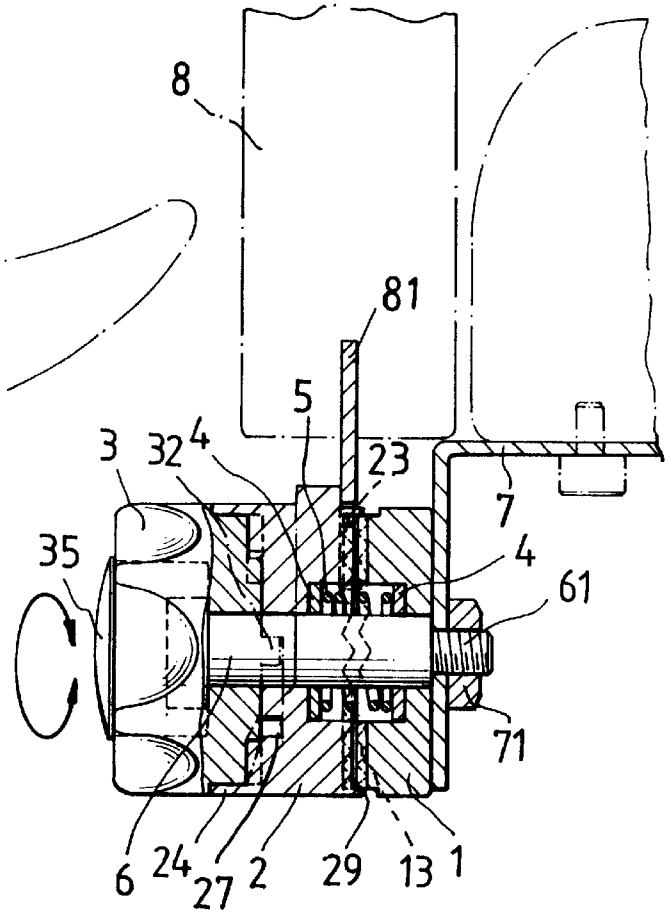
FIG. 3 is a front cross-sectional view of the chair armrest joint adjusted in a loosened condition in the present invention.
Figure 4:
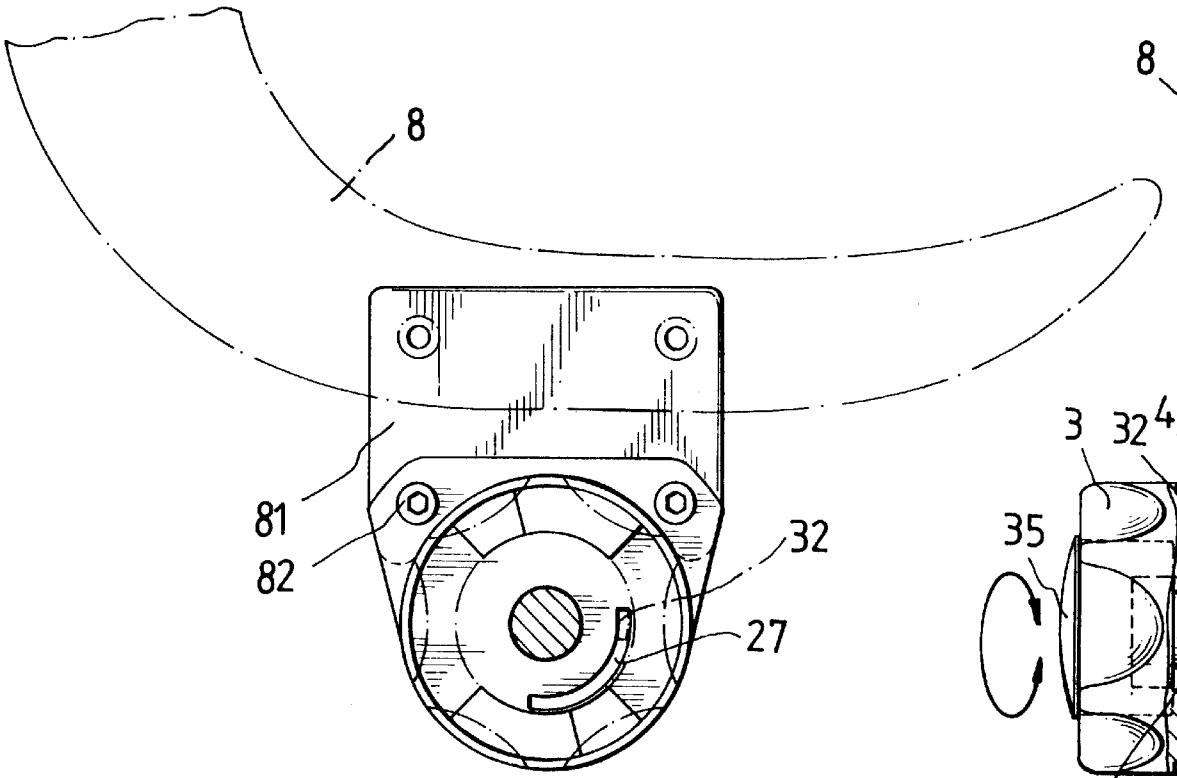
FIG. 4 is a side view of the chair armrest joint fixed with an armrest in the present invention.
Figure 5:
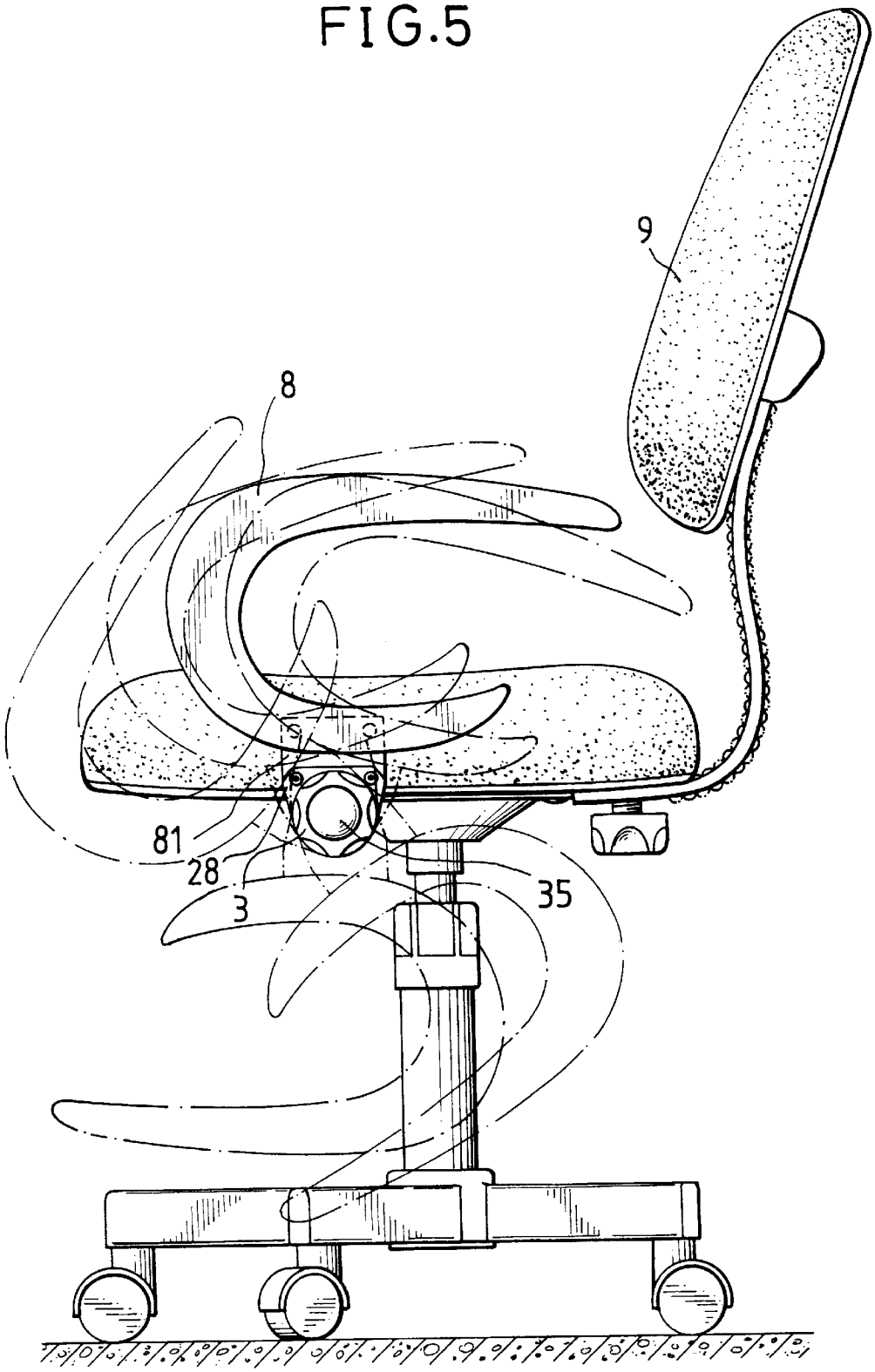
FIG. 5 is a side view of the chair armrest joint fixed under a seat in the present invention, showing it being adjustable to slope in many directions.

When the two armrests 8 are normally in the locked condition as shown in FIGS. 2 and 4, the teeth 13, 23 of the fix member 1 and the movable member 2 engage with each other, and the rotatable member 3 is separated from the movable member 2 with a certain gap, which is equal to the height of the teeth 13, 23. When the armrests 8 are to be adjusted to slope in any direction as shown in FIGS. 3 and 5, the rotatable member 3 is rotated manually for one round, forcing the sloped guide surface 31 to slide along the sloped guide section surface 26 of the movable member 2 to move and contact the lower end of the sloped guide section 26, and at the same time, the projection 32 moves along in the curved slot 27 to its one end in the locked condition. Then the rotatable member 3 and the movable member 2 contact each other tightly, with the spring 5 pressed forward to force the teeth 13, 23 of the fix member 1 and the movable member 2 to contact with each other at their highest points so that the fix member 1 and the movable member 2 are disengaged from each other with a gap.

Then the armrests 8 can be adjusted in their position, able to be handled manually to slope to any direction. After one or two armrests 8 are finished in adjustment, the rotatable member 3 is again rotated reversely, forcing the teeth 13, 23 of the fix member 1 and the movable member 2 to engage with each other tightly as shown in FIG. 2, locking the armrests 8 in that position.

Figure 6:
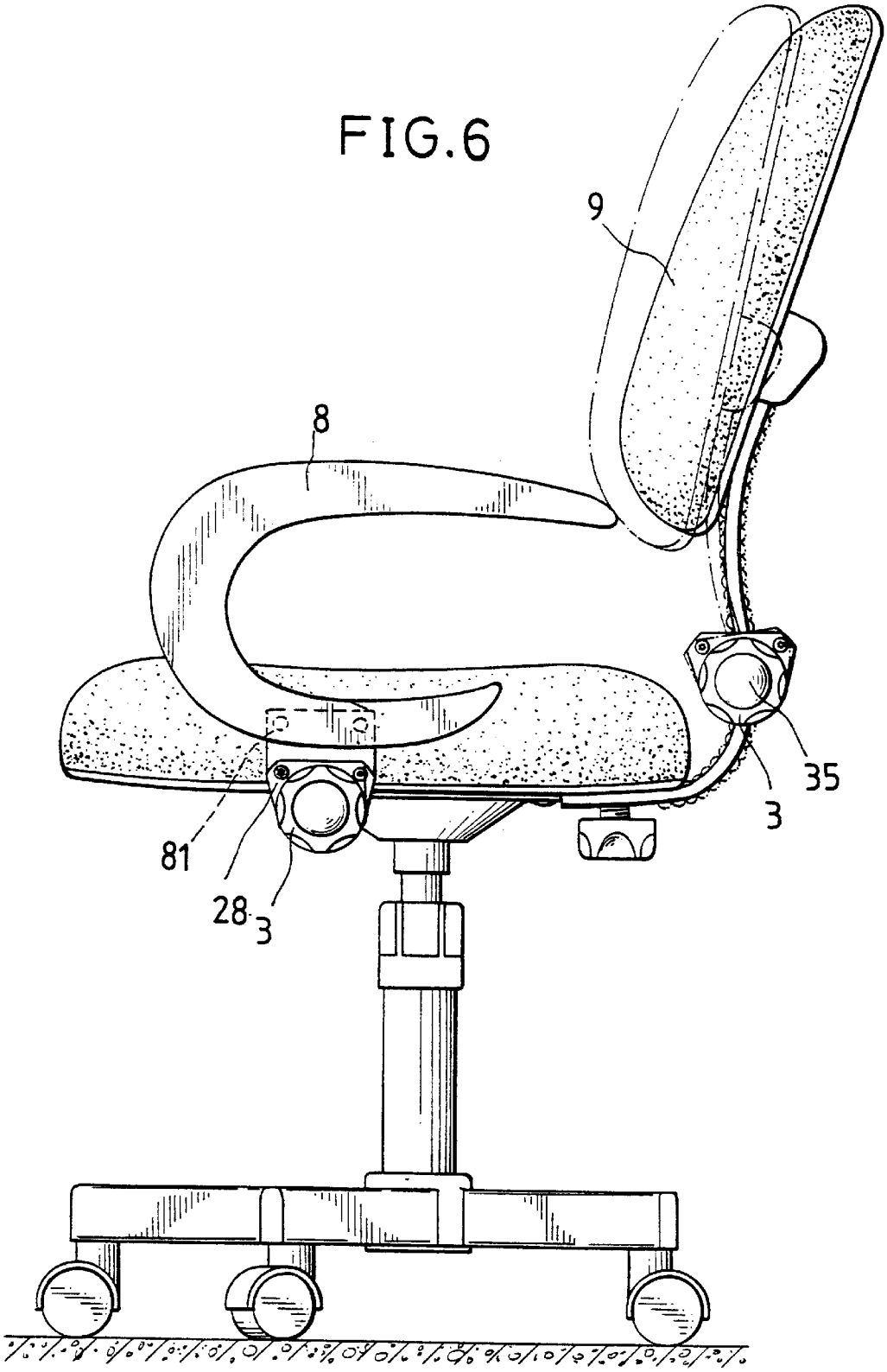
FIG. 6 is a side view of the chair armrest joint fixed with the backrest in the present invention.

Next, FIG. 6 shows the joint for an armrest 8 in the present invention utilized as a joint for a backrest 9, for reclining the backrest 9 in various directions, under the condition that there is sufficient strength between a seat and the backrest 9.

Figure 7:
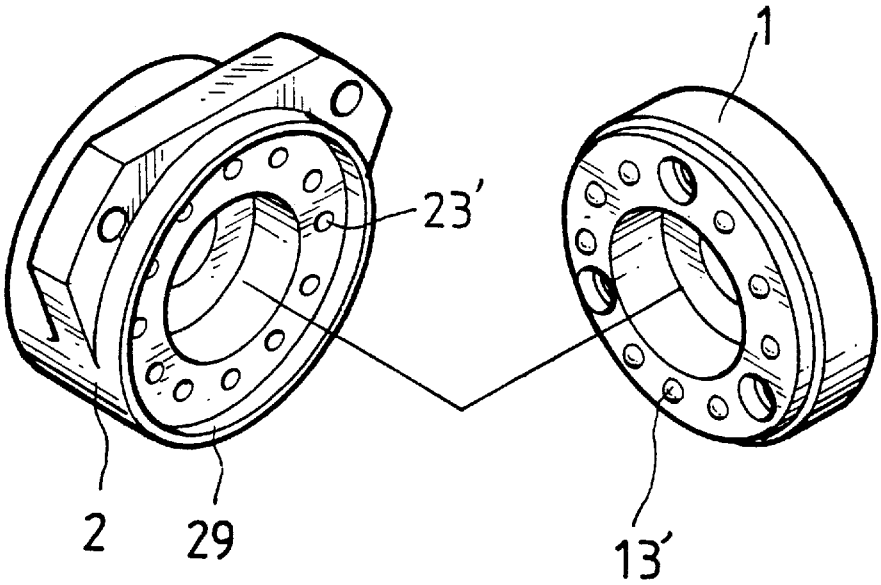
FIG. 7 is a perspective view of a first pair of a movable member and a fix member in the present invention.

FIG. 7 shows a first pair of a fix member 1 and a movable member 2 in a joint in the invention, and the fix member 1 has a plurality of small round projections 13' spaced apart equidistantly in a left side surface, and the movable member 2 has a plurality of small round holes 23' spaced apart equidistantly in a right side surface surrounded by a projecting annular wall 29. The small projections 13' fit in or separate from the small round holes 23' so that the movable member 2 may engage with or disengage from the fix member 1 in adjusting the backrest 9 in various minute directions.

Figure 8:
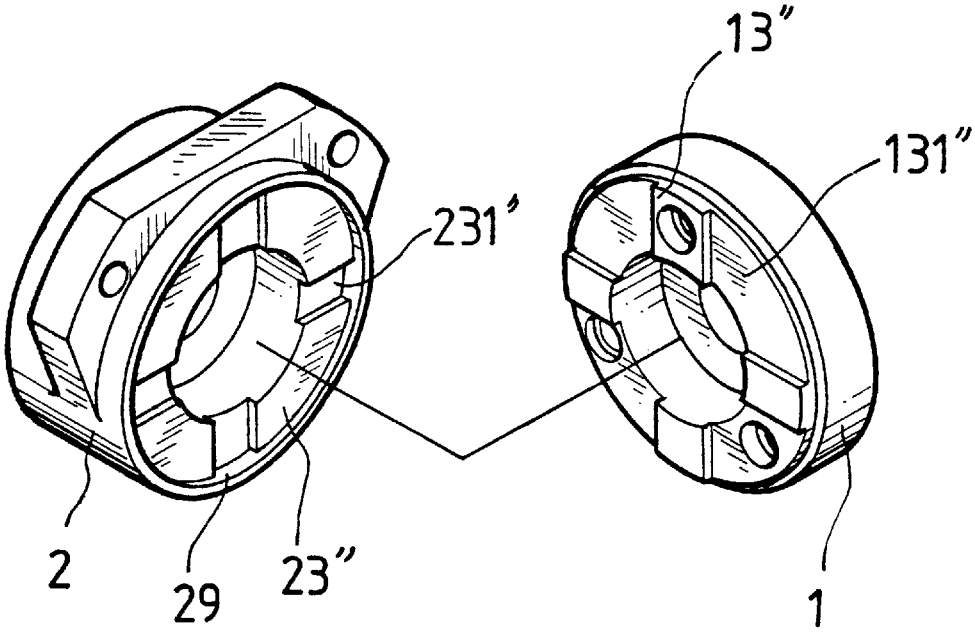
FIG. 8 is a perspective view of a second pair of a movable member and a fix member in the present invention.

FIG. 8 shows a second pair of a fix member 1 and a movable member 2 in a joint. The movable member 2 of FIG. 8 has the right side surface surrounded by the annular projecting wall 29 and including four curved projecting-up sections 23" divided by four recesses 231" in crossing position. The fix member 1 of FIG. 8 has four curved recessed sections 13" divided by four projections 131" in crossing position. The four projections 131" fit in or separate from the four recesses 231" for adjusting the armrest 8 in various minute directions.

Figure 9:
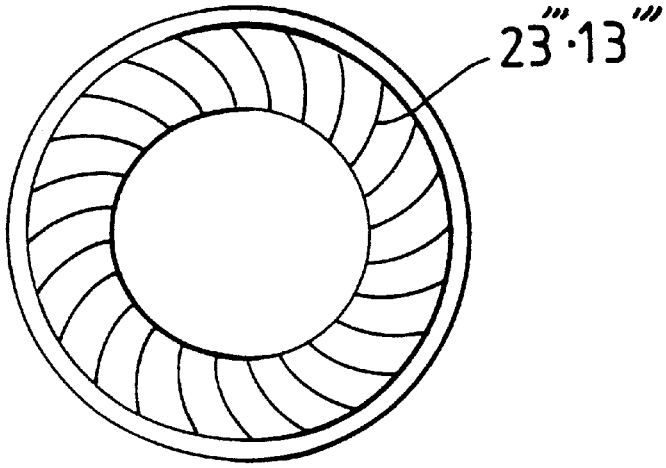
FIG. 9 is a perspective view of a third pair of a movable member and a fix member in the present invention; and, FIG. 10 is a perspective view of a fourth pair of a movable member and a fix member in the present invention.

FIG. 9 shows a third pair of a fix member 1 and a movable member 2 in a joint. The fix member 1 of FIG. 9 has a plurality of radial recesses 13''' continuously provided on a left side surface, and the movable member 2 has a plurality of radial projections 23''' continuously provided on a right side surface. Then the radial recesses 13''' engage with or disengage from the radial projections 23'''. Then the third pair of a fix member 1 and a movable member 2 functions in the same way as the first. The second pairs.

Figure 10:
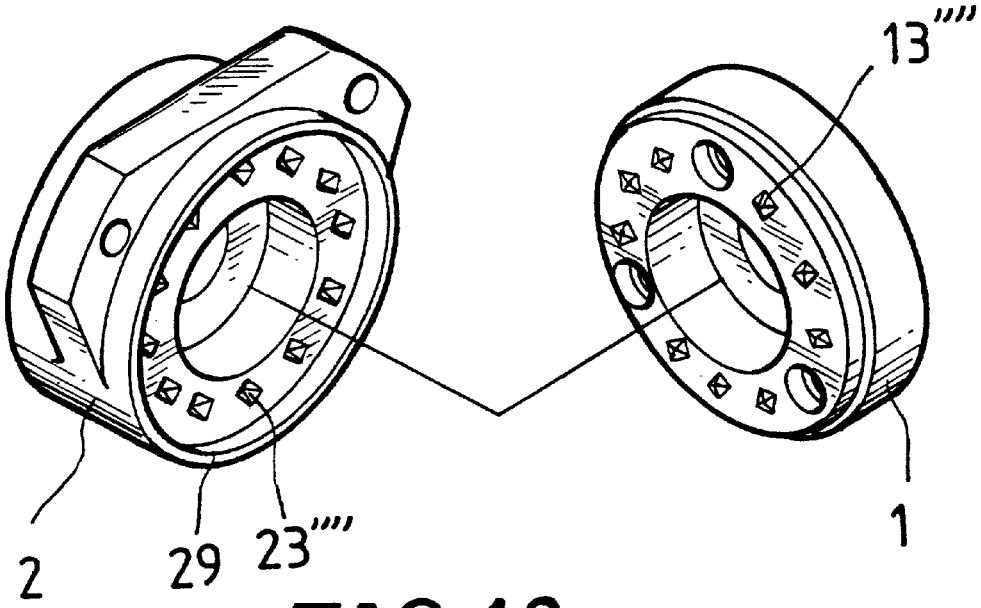

FIG. 10 shows a fourth pair of a fix member 1 and a movable member 2 in a joint. The fix member 1 of FIG. 9 has a plurality of small square or triangular holes 13'''' on a left side surface and the movable member 2 has a plurality of small square or triangular projections 23''''. The holes 13'''' and the projections 23'''' engage with or disengage from each other to perform the same function as the first, the second and the third pairs of the fix member 1 and the movable member 2.

While the preferred embodiment of the invention has been described above, it will be recognized and understood that various modifications may be made therein and the appended claims are intended to cover all such modifications which may fall within the spirit and scope of the invention.

What is claimed is:

1. An adjustable joint between first and second portions of a chair comprising, in combination: a fix member adapted to be fixed to the first portion of the chair; and a movable member adapted to be fixed to the second portion of the chair, with the fix member and the movable member being rotatably and axially movably mounted relative to each other about an axis, with the fix member including a plurality of engagement elements arranged around the axis, with the movable member including a plurality of engagement elements arranged around the axis and engageable with the engagement elements of the fix member, with the movable member being axially movable between an engaged condition where the plurality of engagement elements are in a locked condition preventing relative rotatable movement between the fix member and the movable member and a disengaged condition where the plurality of engagement elements are in an unlocked condition allowing relative rotatable movement between the fix member and the movable member, with one of the fix member and the movable member further including an annular wall radially spaced outwardly of and projecting beyond the plurality of engagement elements, with the plurality of engagement elements of the other of the fix member and the movable member being hidden within and protected by the annular wall in both the engaged and disengaged conditions, wherein the plurality of engagement elements of one of the fix member and the movable member comprises a plurality of radial helical projections and the plurality of engagement elements of the other of the fix member and the movable member comprises a plurality of radial helical recesses engageable with the plurality of radial helical projections.

2. The adjustable joint as claimed in claim 1, further comprising, in combination: a rotatable member rotatable about the axis between a locking position and an adjusting position, with the movable member being in the engaged condition when the rotatable member is in the locking position and being in the disengaged condition when the rotatable member is in the adjusting position.

3. The adjustable joint as claimed in claim 1, wherein the fix member is adapted to be fixed to the first portion in the form of one of a seat and an armrest and the movable member is adapted to be fixed to the second portion in the form of the other of the seat and the armrest.

4. The adjustable joint as claimed in claim 1, wherein the fix member is adapted to be fixed to the first portion in the form of a backrest and a seat and the movable member is adapted to be fixed to the second portion in the form of the other of the backrest and the seat.

5. An adjustable joint between first and second portions of a chair comprising, in combination: a fix member adapted to be fixed to the first portion of the chair; a movable member adapted to be fixed to the second portion of the chair, with the fix member and the movable member being rotatable and axially movably mounted relative to each other about an axis, with the fix member including a plurality of engagement elements arranged around the axis, with the movable member including a plurality of engagement elements arranged around the axis and engageable with the engagement elements of the fix member, with the movable member being axially movable between an engaged condition where the plurality of engagement elements are in a locked condition preventing relative rotatable movement between the fix member and the movable member and a disengaged condition where the plurality of engagement elements are in an unlocked condition allowing relative rotatable movement between the fix member and the movable member, with one of the fix member and the movable member further including an annular wall radially spaced outwardly of and projecting beyond the plurality of engagement elements, with the plurality of engagement elements of the other of the fix member and the movable member being hidden within and protected by the annular wall in both the engaged and disengaged conditions; and a rotatable member rotatable about the axis between a locking position and an adjusting position, with the movable member being in the engaged condition when the rotatable member is in the locking position and being in the disengaged condition when the rotatable member is in the adjusting position, wherein the movable member is biased away from the fix member, with the movable member having an arcuate, axially sloped guide section and the rotatable member having an arcuate, axially sloped guide surface for sliding on the arcuate, axially sloped guide section during rotation of the rotatable member to move the movable member between the engaged and disengaged conditions.

6. The adjustable joint as claimed in claim 5, wherein the rotatable member is limited in its rotation about the axis by an axially extending projection formed on one of the movable member and the rotatable member and received in an arcuate slot formed in the other of the movable member and the rotatable member.

7. The adjustable joint as claimed in claim 5, further comprising, in combination: a center hole formed in the fix member, the movable member, and the rotatable member; and a shaft defining the axis and extending in the center hole formed in the fix member, the movable member, and the rotatable member.

8. The adjustable joint as claimed in claim 7, further comprising, in combination: a center cavity formed in one or both of the fix members and the movable member; and a spring received between the fix member and the movable member in the center cavity for biasing the movable member away from the fix member.

9. The adjustable joint as claimed in claim 8, further comprising, in combination: an axial cavity formed in the rotatable member, with the shaft passing through the axial cavity into the center hole formed in the fix member, the movable member, and the rotatable member; and a cap received in and closing the axial cavity.

10. An adjustable joint between first and second portions of a chair comprising, in combination: a fix member adapted to be fixed to the first portion of the chair; a movable member adapted to be fixed to the second portion of the chair, with the fix member and the movable member being rotatably and axially movably mounted relative to each other about an axis, with the fix member including a plurality of engagement elements arranged around the axis, with the movable member including a plurality of engagement elements arranged around the axis and engageable with the engagement elements of the fix member, with the movable member being axially movable between an engaged condition where the plurality of engagement elements are in a locked condition preventing relative rotatable movement between the fix member and the movable member and a disengaged condition where the plurality of engagement elements are in an unlocked condition allowing relative rotatable movement between the fix member and the movable member; a rotatable member rotatable about the axis between a locking position and an adjusting position, with the movable member being in the engaged condition when the rotatable member is in the locking position and being in the disengaged condition when the rotatable member is in the adjusting position; a center hole formed in the fix member, the movable member, and the rotatable member; a shaft defining the axis and extending in the center hole formed in the fix member, the movable member, and the rotatable member; and an axial cavity formed in the rotatable member, with the shaft passing through the axial cavity into the center hole formed in the fix member, the movable member, and the rotatable member; and a cap received in and closing the axial cavity.

11. The adjustable joint as claimed in claim 10, wherein the movable member is biased away from the fix member, with the movable member having an arcuate, axially sloped guide section and the rotatable member having an arcuate, axially sloped guide surface for sliding on the arcuate, axially sloped guide section during rotation of the rotatable member to move the movable member between the engaged and disengaged conditions.

12. The adjustable joint as claimed in claim 11, wherein the rotatable member is limited in its rotation about the axis by an axially extending projection formed on one of the movable member and the rotatable member and received in an arcuate slot formed in the other of the movable member and the rotatable member.

13. An adjustable joint between first and second portions of a chair comprising, in combination: a fix member adapted to be fixed to the first portion of the chair; and a movable member adapted to be fixed to the second portion of the chair, with the fix member and the movable member being rotatably and axially movably mounted relative to each other about an axis, with the fix member including a plurality of engagement elements arranged around the axis, with the movable member including a plurality of engagement elements arranged around the axis and engageable with the engagement elements of the fix member, with the movable member being axially movable between an engaged condition where the plurality of engagement elements are in a locked condition preventing relative rotatable movement between the fix member and the movable member and a disengaged condition where the plurality of engagement elements are in an unlocked condition allowing relative rotatable movement between the fix member and the movable member, wherein the plurality of engagement elements of one of the fix member and the movable member comprises a plurality of radial helical projections and the plurality of engagement elements of the other of the fix member and the movable member comprises a plurality of radial helical recesses engageable with the plurality of radial helical projections.

14. The adjustable joint as claimed in claim 13, further comprising in combination: a rotatable member rotatable about the axis between a locking position and an adjusting position, with the movable member being in the engaged condition when the rotatable member is in the locking position and being in the disengaged condition when the rotatable member is in the adjusting position.

15. The adjustable joint as claimed in claim 14, wherein the movable member is biased away from the fix member, with the movable member having an arcuate, axially sloped guide section and the rotatable member having an arcuate, axially sloped guide surface for sliding on the arcuate, axially sloped guide section during rotation of the rotatable member to move the movable member between the engaged and disengaged conditions.

* * * * *